United States Patent [19]

Ochs et al.

[11] 3,993,210

[45] Nov. 23, 1976

[54] CONTAINER CLOSURE AND MANUFACTURE

[75] Inventors: Charles S. Ochs; James L. Martin, both of Lancaster, Ohio

[73] Assignee: Anchor Hocking Corporation, Lancaster, Ohio

[22] Filed: Dec. 19, 1974

[21] Appl. No.: 534,658

[52] U.S. Cl. ..... 215/274; 215/321

[51] Int. Cl.[2] ..... B65D 45/30

[58] Field of Search ..... 215/274, 275, 276, 347, 215/337, 329, 321

[56] References Cited

UNITED STATES PATENTS

| | | | |
|---|---|---|---|
| 880,969 | 3/1908 | Butler | 215/347 |
| 1,070,748 | 8/1913 | Stollberg | 215/329 |
| 1,152,107 | 8/1915 | Kerr | 215/276 |
| 1,664,635 | 4/1928 | Magill | 215/274 |
| 1,832,669 | 11/1931 | Thomas | 215/337 |
| 2,718,323 | 9/1955 | Kennedy | 215/347 |
| 3,258,148 | 6/1966 | Unger | 215/347 |
| 3,516,565 | 6/1970 | Hatkevich | 215/347 |
| 3,633,781 | 1/1972 | Zapata | 215/347 |
| 3,820,678 | 6/1974 | Zipper | 215/274 |
| 3,866,782 | 2/1975 | Westfall | 215/274 |

*Primary Examiner*—Ro E. Hart

*Attorney, Agent, or Firm*—Connolly and Hutz

[57] ABSTRACT

A container closure comprises a plastic ring having a top wall and a depending skirt with an annular opening in the top wall. A metal disc is disposed within and against the ring to close the opening. The metal disc is made from a stamped metal which is readily subject to corrosion. The raw edge of the disc is exposed and its internal layer is coated with a corrosion preventing material.

7 Claims, 6 Drawing Figures

Fig. 1.
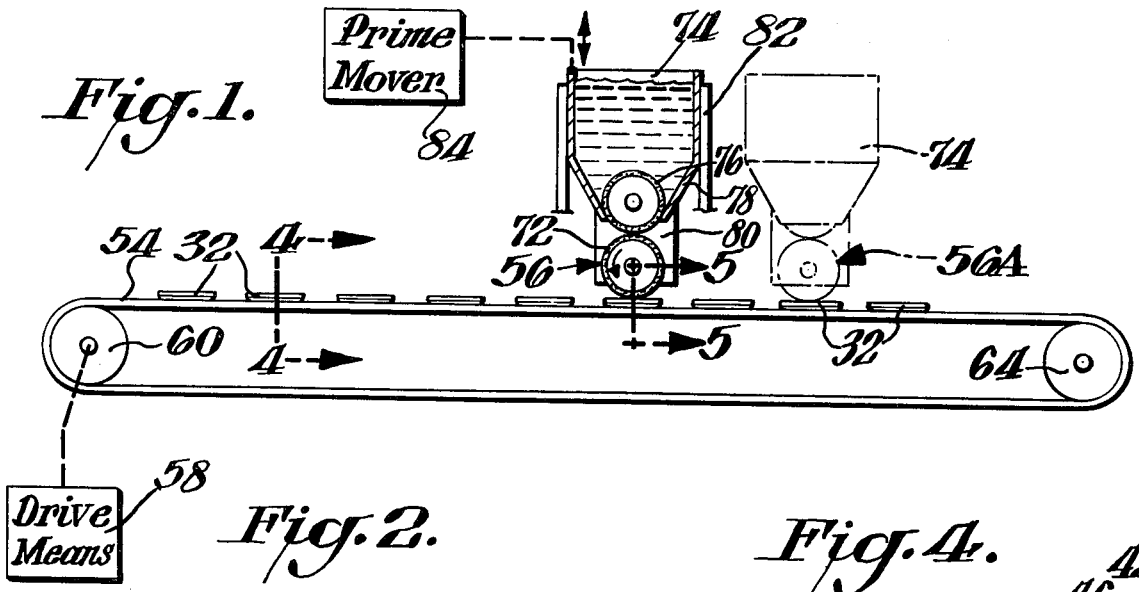
Fig. 2.
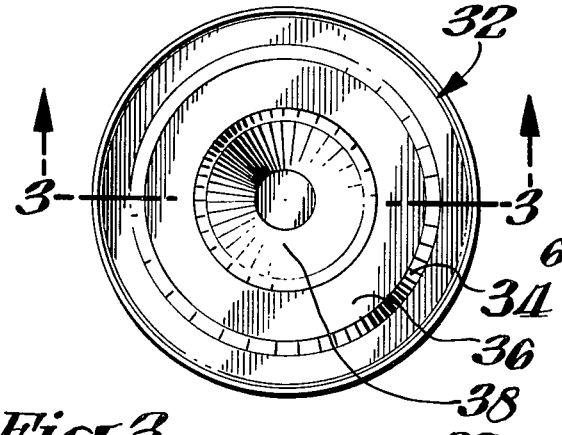
Fig. 3.
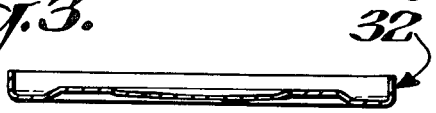
Fig. 4.
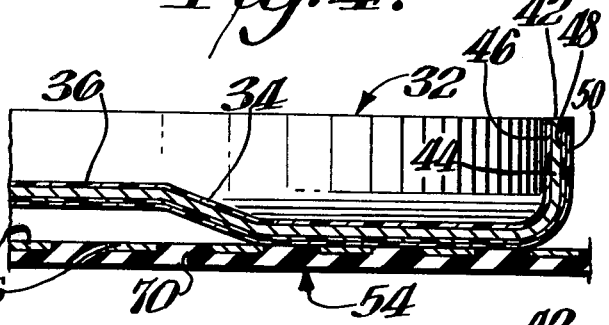
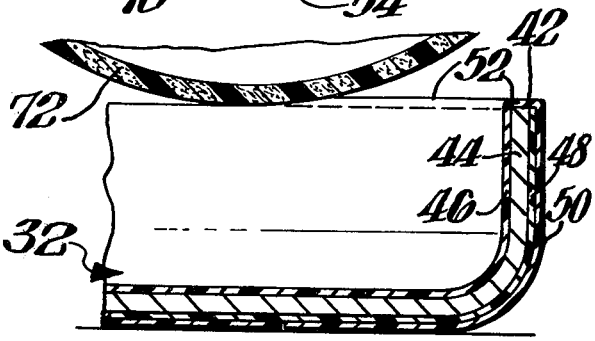
Fig. 5.
Fig. 6.
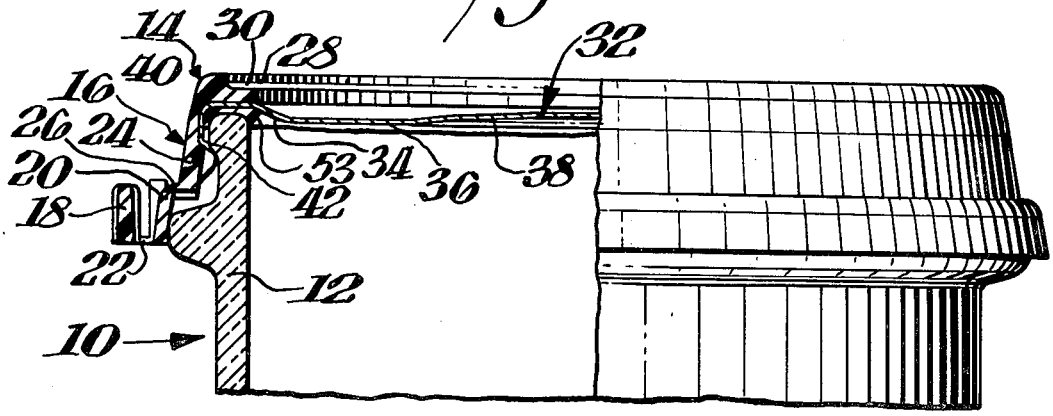

CONTAINER CLOSURE AND MANUFACTURE

BACKGROUND OF THE INVENTION

Container closures frequently incorporate metal discs which have a raw edge by virtue of the stamping process utilized in forming the disc. In conventional twist caps the cut or raw edge is turned under and not exposed directly to any moisture so that no particular problems are presented thereby.

There has recently been developed a closure which consists of a plastic band which is pressed and thumbed or pryed off a glass container. Such closures also include an inner metal insert which affords both product protection and decorative appeal to customer. An ideal material for such metal discs would be a steel disc being, for example, tin plated or chrome plated to provide resistance to corrosion. If such a material, however, were used in the above type closure, its raw edge would be exposed thereby also exposing the steel which is readily susceptible to corrosion. Consequently, although steel has numerous advantages such as magnetic properties for handling both closures and packages, strength, and lower cost, the steel disc has not been used but rather non-corrosive materials such as aluminum have been used to avoid excessive rusting which could occur even if the closure were cold sealed and stored in humid conditions.

SUMMARY OF THE INVENTION

An object of this invention is to provide improvements in the above type closure manufacture which permits a steel disc to be employed therein thereby taking advantage of the desirable properties of this material.

A further object of this invention is to provide a method of forming such closures which is readily adaptable to existing manufacturing techniques.

A still further object of this invention is to provide a closure manufacturing system which permits the use of steel in the manufacturing of such closures.

In accordance with this invention the exposed raw edge of the metal disc is coated with a corrosion preventive material such as an organic coating which is applied to the raw edge by a resilient roller which rotates above and in contact with the raw edge as the disc travels on a conveyor. In an advantageous form of this invention the closure also includes a thermoplastic lining such as plastisol which acts as a sealing gasket and both the lining and coating are cured simultaneously in the same heating operation.

THE DRAWINGS

FIG. 1 is a side elevation view schematically illustrating an assembly for coating the raw edge in accordance with this invention;

FIG. 2 is a top plan view of a metal disc which is to be coated in accordance with this invention;

FIG. 3 is a cross-sectional view taken through FIG. 2 along the line 3—3;

FIG. 4 is an enlarged fragmental cross-sectional view taken through FIG. 1 along line 4—4;

FIG. 5 is an enlarged fragmental cross-sectional view taken through FIG. 1 along line 5—5; and FIG. 6 is an elevation view partly in section showing a completed closure mounted on a container in accordance with this invention.

DETAILED DESCRIPTION

FIG. 6 illustrates a container 10 made of a suitable material such as glass having a neck 12 and which is closed by closure 14. Closure 14 includes a ring member 16 made of a suitable plastic material which is applied to the closure by being pressed on and can be removed by being thumbed or pryed off in a conventional manner. As illustrated in FIG. 6, the plastic ring includes a tear tab grip portion 18 joined to the tear tab 20 by gate 22 which in turn is joined to the skirt 24 of ring 16 by peripheral web 26. Ring 16 further includes a top wall 28 having an annular central opening whereby the top wall is defined by the peripheral rim 30. Rim 30 is disposed for fitting above the top edge of the container neck 12 while the skirt 24 is generally disposed along the side of the container.

Mounted within the ring 16 is a metal disc 32. As shown in FIG. 6, disc 32 includes a top wall which fits under and against rim portion 30 and completely closes the annular opening in the rim 16. In the illustrated embodiment disc 32 includes a peripheral tapered portion 34 which merges into planar portion 36 which in turn merges into upwardly extending central portion 38 to facilitate the sealing operation. The disc further adds decorative appeal to customers, as well as product protection.

Disc 32 as also shown in FIG. 6, includes a downwardly depending skirt portion 40 with a horizontally disposed exposed edge 42 completely out of contact with the skirt 24 of ring 16 as well as being out of contact with the container neck finish 12. Although FIG. 6 illustrates edge 42 to be out of contact with, for example, skirt 24, it may be in contact but the raw edge would still be subject to corrosion.

In accordance with this invention disc 32 is made of a plated metal having an internal base member made of a material readily susceptible to corrosion or may be an unplated metal subject to corrosion such as black plate. Since steel had distinct advantages over other materials such as magnetic properties for handling both closures and packages, strength, and lower cost, in a preferred form of this invention steel is used as the internal base layer and the steel is plated on each side by outer layers which are corrosion resistant such as tin plating or chrome plating. Where black plate is used the sides are made corrosion resistant by the coatings applied to the inside and outside of the closure. The steel itself however, is readily susceptible to corrosion and for this reason has not been generally used in manufacturing such closures used in wet packaging. Ordinarily, with other type closures because of the plating operation the selection of steel for the closure material would not present any particular problems. Conventionally, however, in forming metal closures the desired shape is stamped from the plated steel thereby forming a raw edge wherein a limited thickness of steel is exposed peripherally around the center of the stamped metal disc. As illustrated, for example, in FIGS. 4 and 5, the composite layers of plated steel are designated by the reference numeral 44. Frequently, prior to the stamping operation the plated steel may undergo other operations for various reasons such as applying an organic coating 46 (FIG. 4) to one side thereof and organic coatings 48, 50 to the other side. Any protection from a corrosion - resisting standpoint which might have otherwise been imparted by these ancillary coating operations is negated when the disc is stamped from the plate and the raw edge, and in particular the steel, is thereby exposed.

In accordance with this invention the problems created by such a raw edge are obviated in a simple and convenient manner by applying a coating of corrosion resistant material 52 to the exposed raw edge. The application of this coating will be described in further detail hereinafter.

Returning again to FIG. 6, the closure 14 further includes a lining material 53 made, for example, of a thermoplastic such as a suitable plastisol which is flowed in while the disc or insert rotates to conform to the insert shape and conforms to the shape of the container finish by heat and/or pressure to have the final desired shape as illustrated in FIG. 6. Such materials are known in the art and a detailed description of the materials or its manner of curing is not necessary herein.

The various closure components are formed and assembled and are mounted on container 10 in a conventional manner and accordingly a detailed discussion thereof is not necessary. FIG. 1, however, illustrates a particular aspect in the closure formation manufacture which relates to the treatment of the already formed disc in accordance with this invention. Generally, as illustrated in FIG. 1 the discs are mounted on a conveyor 54 with raw edge 42 facing upwardly (FIGS. 4–5) so that the raw edge is uniformly contacted by applicating roll assembly 56.

In the preferred form of this invention the corrosion preventing material is an organic coating. Suitable materials, for example, include the following basic types: vinyl, acrylic, epoxy, polyester, epoxy ester, phenolic, alkyd, acrylic modified alkyd, melamine, and urea. It is also possible in accordance with this invention to comprise the coating of a combination of several materials such as the above noted types. The coating would then be of the usual base type wherein common organic solvents such as ketones, esters, alcohols, aromatics, ethers or glycols are used as the carrying agent for the aforementioned vehicle types.

Still further the coating could also consist of a basic resin backbone from the class of either vinyl, acrylic, polyester, phenolic or epoxy types wherein the major constituent of the volatile portion or carrying agent would be water with little or no co-solvent (organic type) present. This type of coating is commonly referred to as a water base or water reducible coating.

The coating may further be either of a thermosetting or thermoplastic type.

The above described coatings require heat from a thermal source to effect their curing or drying. As later discussed such materials are particularly advantageous when used with a thermoplastic liner such as plastisol. It is, however, also possible to practice the broad concepts of this invention by use of a coating which cures immediately such as when exposed to ultraviolet radiation, electron beam radiation or plasma arc radiation. These coatings might, for example, consist of acrylic monomers and copolymers, styrene, reactive diluents, unsaturated polyesters, oligmers, photosensitizers and inhibitors.

Any of the above discussed coatings whether thermal curing or not could be used as a pigmented coating or as a clear coating with no pigment present.

As shown in FIG. 1 and also with reference to FIGS. 2–5, the coating 52 is applied to raw edge 42 by the utilization of two preferable pieces of equipment, namely, an applicator such as roll applicator assembly 56 and a conveyor such as conveyor 54 which transports the insert 32, to, through and away from applicator assembly 56. Although such equipment is preferable, the invention may be practiced by other means such as feeding the discs or inserts from a chute to the coating roll or by some other method. Other methods may also be used for the coating. Similarly, although any suitable conveyor may be utilized in accordance with the broad aspects of this invention it is particularly desirable that the conveyor be so constructed that there is no up or down movement directly under the applicator and likewise very little sideways movement. FIG. 1, for example, illustrates a preferred form wherein a magnetic type belt conveyor is utilized which includes a drive means 58 for rotating a drive roll 60 and the conveyor 54 thus rotates over and is driven by rolls 60 and 64. The individual belts include permanent magnets 66 with any suitable webbing material 70 being utilized as illustrated in FIG. 4. The conveyor utilizes magnetic attraction to hold the metal discs in place even while the discs are being brushed by the applicator. Instead of a magnetic conveyor, the conveyor may be a vacuum conveyor or chain conveyor. Thus although the type of conveyor illustrated in FIGS. 1 and 4 is particularly desirable other forms of conveyor may be used such as metal, plastic, canvas, etc.

The applicator or coater assembly 56 preferably is formed with a round application roll 72 made, for example, of a suitable resilient material such as rubber and which includes some means of metering the amount of coating from a supply fountain 74 onto the applicator roll 72. Any suitable metering means may be used such as doctor blades, doctor rolls, a pair of steel metering rolls with the ability to vary the distance between them or the metering means may be provided by having a supply fountain which is placed directly against the applicator roll thereby permitting variation in the amount of coating applied by changing the distance between the roll and fountain. FIG. 1 schematically illustrates the applicator assembly 56 to include applicating roll 72 mounted for rotation juxtaposed metering roll 76 which in turn is disposed in the fountain 74 with the inclined sides 78 acting as a doctor blade. It is to be understood that the arrangement illustrated in FIG. 1 is intended solely to exemplify a manner of carrying out some of the preferred requirements for practicing the invention. FIG. 1, for example, illustrates the applicator roll 72 to include a mounting device 80 connecting the applicator roll to fountain 74, with the fountain in turn being mounted for vertical movement up and down in frame 82 and with the movement being effected by a prime mover schematically illustrated as 84. The rolls 72 and 76 may be movable independently of each other and of the fountain to provide sufficient versatility in locating the applicator with respect to the inserts and for varying the amount or thickness of coating, as well as the coating rate.

Coating device 56 is disposed directly over conveyor 54 with the applicator roll 72 rotating in the same direction and at approximately the same speed as the conveyor. By varying the height from the top of the conveyor to the bottom of coating roll 72, it is possible to have the applicator roll 72 barely touch the insert passing therebeneath.

As also illustrated in phantom outline in FIG. 1, a second applicator assembly 56A may be provided for insurance against any skip marks from the upstream applicator assembly 56.

Curing of the coating material may be accomplished in various ways in accordance with this invention. For example, in one form of this invention the coating may be heat cured immediately after application. Alternatively, the coating may be cured by various radiation techniques as previously noted either before the plastisol gasket or lining is injected or immediately after that operation. In the preferred form of this invention, however, the coating is heat cured at the same time that the thermoplastic gasket lining is heated thereby taking advantage of the heating operation which would otherwise necessarily be required where such a lining material is utilized.

Although this invention has been particularly described with respect to specific coating materials and exemplary types of application equipment, it is to be understood that various modifications may be made within the scope of this invention and that the specific details described herein are intended merely to be exemplary.

What is claimed is:

1. A container closure comprising a plastic ring, said ring having a generally horizontal narrow rim and a depending skirt for engaging the finish on the neck of the container, said rim having a relatively wide central opening extending completely through said rim, said rim being disposed for being mounted above the upper edge of the container neck, a disc inserted within said ring beneath said rim, said disc being made of a stamped metal having a generally horizontal top wall and a generally vertical downwardly extending peripheral flange terminating in a raw edge extending completely around its periphery, said top wall of said disc being disposed against and under said rim of said ring and said disc top wall completely closing said central opening of said ring, said downwardly extending flange of said disc being disposed against said skirt of said ring, said raw edge of said disc being exposed, said metal of said disc including a metal layer which is readily subject to corrosion, a corrosion preventing coating applied to said raw edge and covering said raw edge, and said raw edge coating being confined to the general area of said raw edge and being distinct from any other coating which may be on said disc.

2. A container closure as set forth in claim 1 wherein said metal is plated steel and said corrosion preventing coating is an organic coating.

3. A container closure as set forth in claim 2 wherein said coating is a lacquer.

4. A container closure as set forth in claim 1 wherein said layer is plated steel, a thermoplastic lining being disposed beneath and in contact with said top wall and said depending skirt of said disc, and said corrosion preventing coating being a thermal cured coating.

5. A container closure as set forth in claim 1 wherein said metal is black plate and said corrosion preventing coating is an organic coating.

6. A container closure as set forth in claim 1 wherein a primary coating substance is applied to at least one side of said disc prior to stamping, and said raw edge coating being distinct from said primary coating substance.

7. A container closure as set forth in claim 1 wherein organic coatings are applied to both sides of said disc prior to stamping, and said raw edge coating being distinct from said organic coatings on said sides of said disc.

* * * * *